US006655826B1

(12) United States Patent
Leanos

(10) Patent No.: US 6,655,826 B1
(45) Date of Patent: Dec. 2, 2003

(54) DEVICE FOR THE TREATMENT OF LIQUIDS BY MECHANICAL VIBRATION

(76) Inventor: Eliseo Alfredo Bonilla Leanos, Paseo de la Asuncion Norte 311, Jardines de Aguascalientes, Aguascalientes, Aguascalientes (MX), 20270

( * ) Notice: Subject to any disclaimer, the term of this patent is extended or adjusted under 35 U.S.C. 154(b) by 0 days.

(21) Appl. No.: 09/720,032

(22) PCT Filed: Jun. 26, 1998

(86) PCT No.: PCT/MX98/00027

§ 371 (c)(1),
(2), (4) Date: Mar. 20, 2001

(87) PCT Pub. No.: WO99/43422

PCT Pub. Date: Sep. 2, 1999

(30) Foreign Application Priority Data

Feb. 25, 1998 (MX) ..... 981504

(51) Int. Cl.[7] ..... B01F 11/00
(52) U.S. Cl. ..... 366/119; 366/127
(58) Field of Search ..... 366/108, 113, 366/114, 117–122, 124, 127, 319

(56) References Cited

U.S. PATENT DOCUMENTS 973,921 A * 10/1910 Dodge
1,766,033 A * 6/1930 Meakin
1,858,796 A * 5/1932 Wilcoxson
1,911,966 A * 5/1933 Pickop
2,068,099 A * 1/1937 Engle
2,139,585 A * 12/1938 Hunter
2,214,142 A * 9/1940 Mall
3,282,055 A * 11/1966 Landau
4,252,444 A * 2/1981 Herz
4,483,695 A * 11/1984 Covey, Jr.
4,778,279 A * 10/1988 Bodine
4,983,045 A * 1/1991 Taniguchi

* cited by examiner

*Primary Examiner*—Charles E. Cooley
(74) *Attorney, Agent, or Firm*—Jones, Tullar & Cooper, PC

(57) ABSTRACT

A device treats liquids such as water by mechanical vibration. This vibration reaches a useful frequency by the harmonics of the primary vibration, for the destruction or inhibition of microbiological organisms contained in the water. This primary vibration is obtained by the passage of the liquid through a helix that carries the liquid, which in turn impacts and displaces a plurality of rods or elongated elastic bodies in order to obtain a mechanical vibration. This vibration is preferably controlled by the action of the electrical capacitance between the vibrating rods and the helix vanes that conduct the liquid, for which purpose the rods are connected to a pulsating electric energy source. This primary vibration is also controlled by the action of a permanent magnetic field produced by semi conducting media arrayed on a central tubular support of the helix, in such a way that the harmonics of the vibration that affect the incompressible liquid are transmitted to the biological contents of the liquid.

13 Claims, 4 Drawing Sheets

DEVICE FOR THE TREATMENT OF LIQUIDS BY MECHANICAL VIBRATION

BACKGROUND OF THE INVENTION

1. Field of the Invention

The present invention relates in general to an apparatus for treating fluids by imparting high frequency vibrations to the fluids.

2. Description of the Background Art

Water in liquid state is an essential element for life. Certain minimal potability conditions, which refer not only to the water's physical or chemical characteristics but to its microorganism contents are required in order to use this liquid for human consumption. In order to eliminate said microorganisms, chemical treatments for potabilization such as the application of ultraviolet radiation, reverse osmosis, and even boiling the liquid at home are used, some of them with adverse side effects. Simple filtration of the liquid is not enough to eliminate harmful microorganisms. The need of water for human consumption, which complies with health requirements has given origin to water treatment in an industrial scale, and even if it complies with purity standards, it has a very high cost. It can be stated that there is no device in the market for either industrial or domestic use that for a reasonable cost and easy installation, provides a dependable form to treat water according to health standards.

SUMMARY OF THE INVENTION

The behavior of a liquid medium, to be virtually incompressible, is known. A displacement or pressure applied to part of said liquid is transmitted to all of the liquid's volume, and a vibration exerted to say liquid will derive in the resulting vibration of the liquid and its contents. The present invention is distinguished from known inventions as it provides a device that allows the application of mechanically originated vibrations to a fluid medium, specifically to liquids. The device takes advantage of the incompressibility characteristic of liquids in such a way that the undulation of elastic media in the liquid will result in the liquid's vibration.

The undulation of these elastic media will be such as to provide a primary vibration and its harmonics at very high frequencies in the neighborhood of megahertz, which when applied to a liquid, will make this liquid and its contents vibrate. Due to the primary vibration frequency and its harmonics, which will turn out to be the frequency that impacts the mass of the biological contents of the liquid with the greatest intensity, the vibration will thereby destroy, inhibit or affect the reproduction of algae, fungi, bacteria or viruses in the liquid.

Thus, the invention provides in a functional combination, a plurality of elongated elastic rods, which are disposed in a liquid flow stream, and means for directing the liquid into contact with the elastic rods in such a manner that causes the elastic rods to vibrate. This vibration in turn imparts a vibration to the liquid, thereby treating the liquid by destroying or inhibiting the growth of the biological contents of the liquid. In the preferred embodiment, a multiple vane helix is positioned in the flow stream and each of the elongated elastic rods passes through perforations or apertures in each of the vanes. The rods are held loosely in the perforations so that as the vanes direct the liquid flow through the helix in a generally spiral fashion, the liquid will impact each of the rods, thereby causing a displacement of the rods which results in a resonant vibration of the same. To enhance the vibration of the rods further, an electrical capacitance effect is employed wherein a pulsating high frequency electrical current is applied to the helix vanes and the elastic rods, which in effect act as opposite polarity plates of an electrical capacitor. The vibration of the elastic rods is also preferably increased and controlled by a permanent magnetic field that is produced by a plurality of semiconductor bodies contained in a central support tube of the helix. The magnetic field acts over the elastic rods in a such a way that the undulation of the rods is further enhanced and controlled.

The essential purpose of the invention is thus to provide a device for the treatment of liquid fluids that takes advantage of the liquids— incompressible characteristic, thereby using the liquid as a vehicle for the application to its biological content of undulations or vibrations produced by elastic media with controlled intensity and frequency, so that this vibration will considerably affect fungi, algae, bacteria or viruses contained in the liquid.

Another purpose of the invention is to provide a tubular container for the liquid that allows its circulation and a helix, which directs the liquid towards the vibration elements in the helix and is supported by the tubular container.

Another purpose of the invention is to provide vibration media, consisting of elongated elastic elements or rods, which act in the helix that directs the liquid flow, which elements are displaced with an undulatory movement by the circulation of the liquid in the helix.

Another purpose of the invention is to provide, by the effect of electrical capacitance, an increase in the vibration of the elastic rods or elements, produced by the interaction of a pulsating current in the helix as well as on the elastic elements, which capacitance increases the displacement of the vibrating elastic rods or elements and also determines the desired range of oscillation.

Another purpose of the invention is to provide in such a device, magnetic media generating low power lines of force that contribute to the intensity and frequency control of the vibration of the elastic rods or elements.

BRIEF DESCRIPTION OF THE DRAWINGS

In the following description of a preferred embodiment of the invention, the same numbers designate the same parts on the different figures of the drawings, in which.

DESCRIPTION OF THE PREFERRED EMBODIMENT

Figure 1:
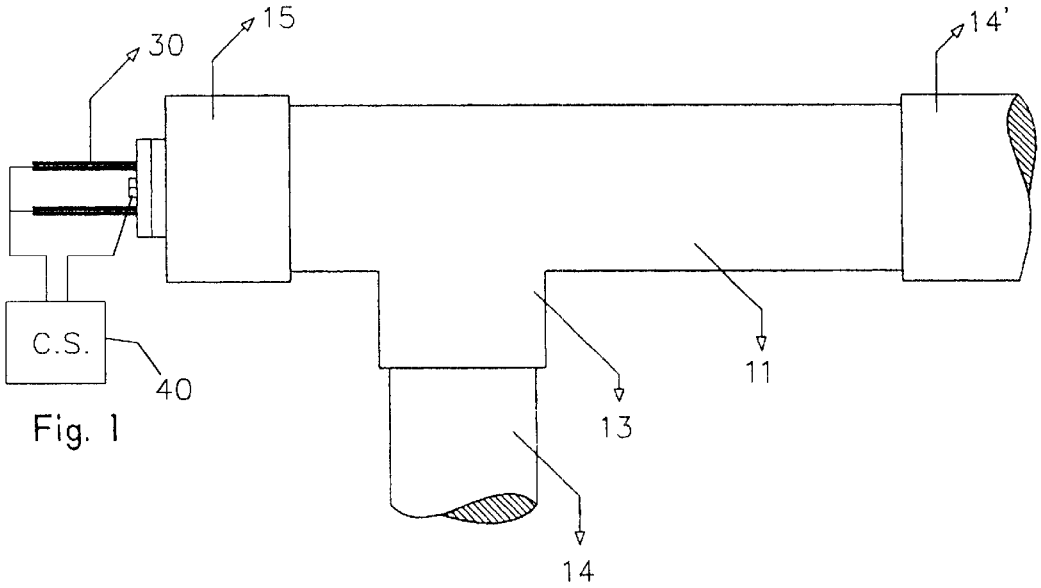
FIG. 1 is a lateral elevation of the device showing its installation in a hydraulic system, which provides a passage for liquid fluid for its treatment by the application of a mechanical vibration.

The modality of the invention as illustrated in the drawings comprises a tubular container 11, which is open both at a threaded back end 11', and at a front end 12, and is provided with an apertured lateral projection 13. The lateral projection 13 acts as a liquid intake to the container 11 and is connected to a first pipe 14, which supplies water or other liquid to be treated from a hydraulic system or other source of liquid to the container 11. A second pipe 14' is connected to the front open end 12 of the container 11, which open end 12 acts as an outlet for the device, for redirecting the water or liquid back to the hydraulic system after treatment by the present invention. A closing cap 15, with threaded media 15', is screwed onto the threaded open end 11' of the container 11 and has an elongated tubular cylinder 16 fixed to its center, which cylinder has a front open end 17, in which is disposed a stopper 18. A back end 19 of the elongated cylinder 16, is affixed to the cap 15 by a bolt 19'. To provide a watertight connection between the cap 15 and the container 11, an annular washer 20 is disposed between the cap 15 and the open end 11' of the container 11.

The central cylinder 16 supports a helix 21 for the flow of the liquid to be treated. The helix 21 includes a plurality of vanes 22, each of which has a plurality of interspaced perforations or apertures 23.

Figure 2:
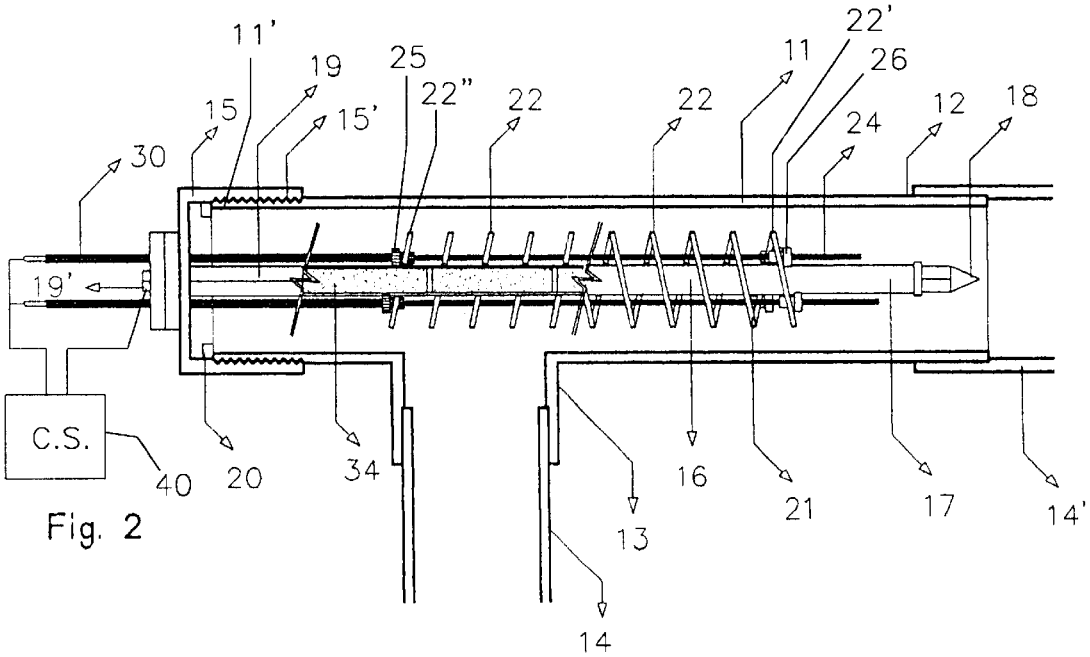
FIG. 2 illustrates in a cross section a lateral elevation of a tubular container and the relative array of the central support, fluid conduction helix and rods or elongated vibration bodies, as well as the central support cylinder and permanent magnetic field semiconductor media.
Figure 3:
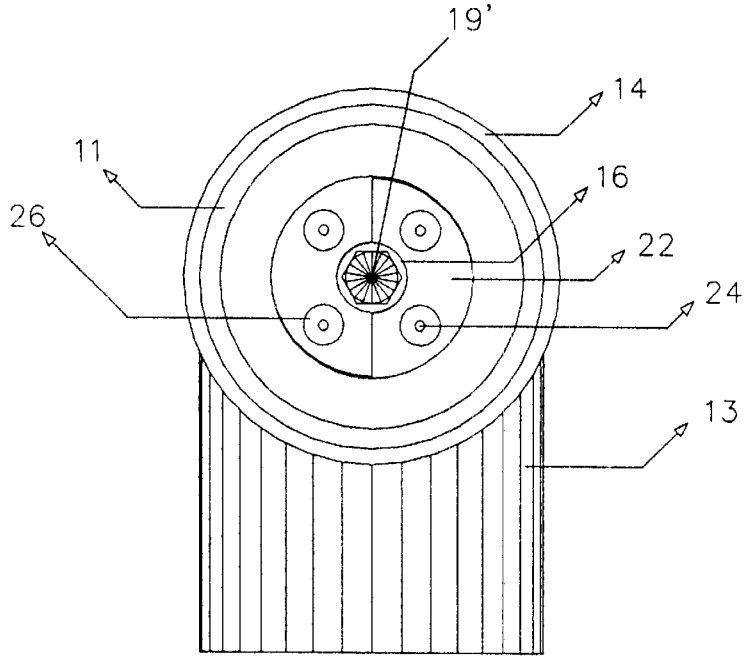
FIG. 3 illustrates in a front elevation, the assembly of fluid flow helix and the central support cylinder, containing the semiconductor field generation media.
Figure 4:
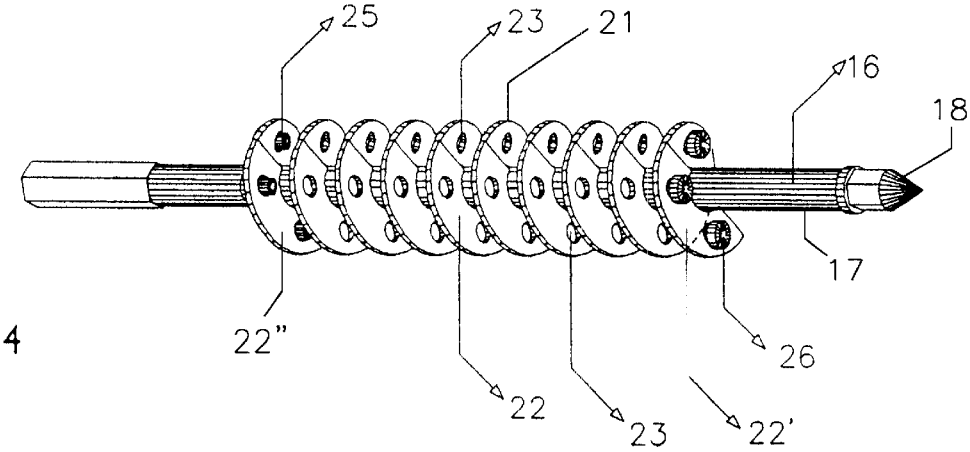
FIG. 4 illustrates in a conventional perspective the helix and central supporting cylinder assembly, showing the relative position of this helix with interspaced perforations in its vanes, as well as the supporting means for the vibrating elements or rods.
Figure 5:
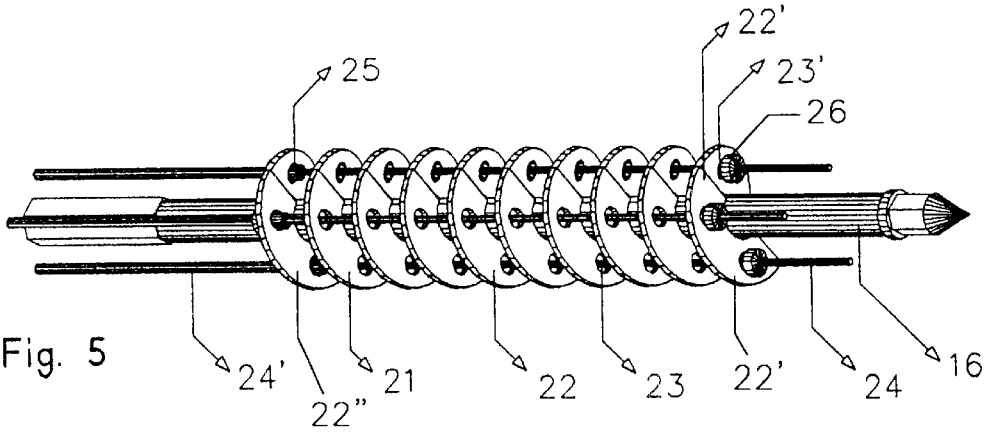
FIG. 5 is a lateral perspective view of the assembly of the central support and liquid flow helix and the oscillating elastic rods, operating in the center of the perforations in the vanes of said helix.
Figure 6:
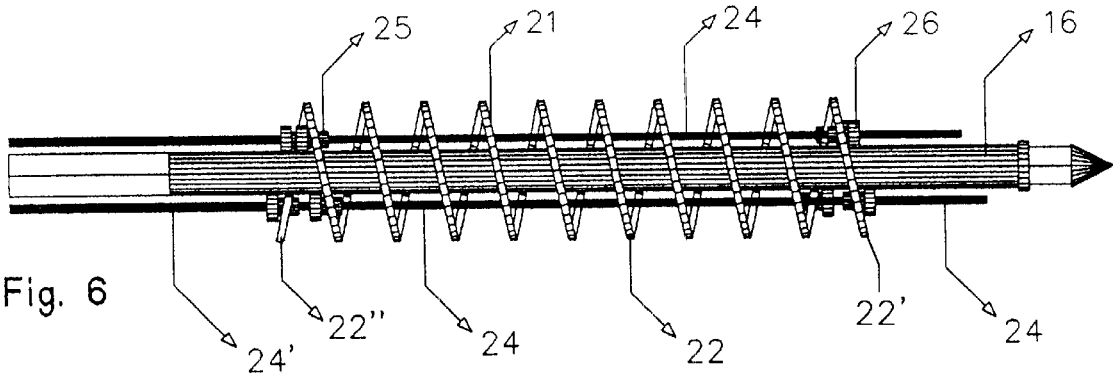
FIG. 6 is a lateral elevation, showing the helix assembly, vibrating elastic rods, central support and means for fixed support and free sustainment of the rods.
Figure 7:
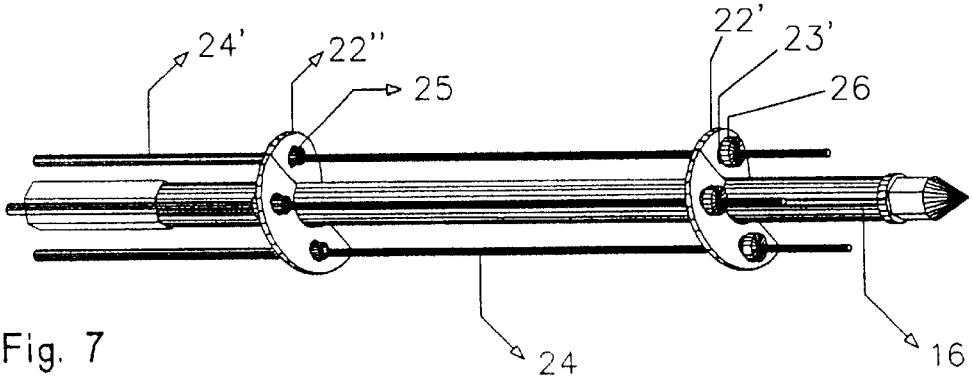
FIG. 7 is a perspective elevation, showing on the back vane of the helix assembly, the rod supporting bushings and in its front vane, the free sustainment means for the rods, as well as showing the different lengths of these rods for obtaining different frequencies of the vibrations.

The illustrated modality of the invention includes four elongated cylindrical bodies or rods 24, each of which is elastic to facilitate displacement and thus vibration in response to the flow of liquid into contact with the rods 24. Preferably, the rods 24 are of different lengths to obtain resonant vibrations of different frequencies. Each of the rods 24 is attached at first fixed ends 24' to a corresponding one of a plurality of bushings 25 that are secured to a first, rear vane 22" of the helix 21. As illustrated in FIG. 2, the first, rear vane 22" is aligned approximately with one side of the liquid intake lateral projection 13.

A last, front vane 22' of the helix 21 contains a plurality of larger diameter perforations or apertures 23' in each of which a corresponding one of a plurality of centering bushings 26 is inserted for reception of the elastic rods 24, which are allowed certain free movement when vibrating in order to compensate their position during undulation.

This assembly of the central support 16 and multiple vane helix 21 will provide an adequate flow for the liquid for a longer distance than the length of the tubular container 11. With the elongated bodies or rods 24 positioned in the passage of the liquid, this liquid, when flowing towards the rods 24, will displace them, according to the length of each rod, and its position in the different vanes 22 of the helix 21.

The elasticity of the rods 24, will force such rods to return to their original position, which will result in a vibration of these rods 24 which is transmitted to the liquid in movement.

Figure 8:
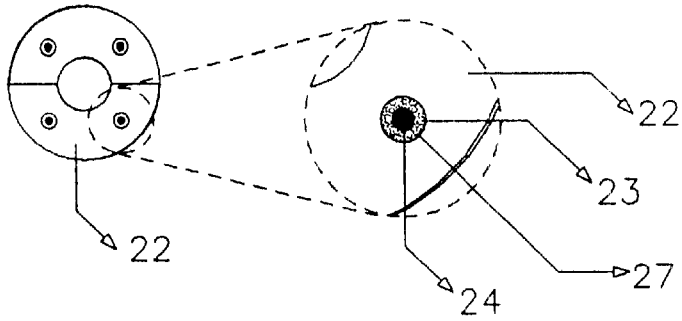
FIG. 8 is a front view of a vane of the helix, showing the relative position of an elastic rod in the center of a perforation in the vane, which in the partially enlarged view, shows the existence of liquid around the rod and schematically the array of a dielectric material within the vane's perforation.

Preferably, the described assembly also provides an electrical capacitance effect which results from the combination of rods 24 with the perforations 23 in the vanes 22. The perforations 23 are shown in detail in FIG. 8, which shows a single one of the vanes 22, with the perforations 23 that correspond to each of the rods 24. An insulating coating 27 or dielectric is disposed between the rods 24 and the edges of the perforations 23 which provides the capacitance effect mentioned between the rods 24 and the vanes 22 when an electrical potential is applied across these elements.

This capacitance provides for each of the rods 24 a displacement effect which is multiplied by the number of the vanes 22, and which is added to the thrust already been applied to the rods 24 by the liquid mass flowing through the vanes 22.

To obtain the desired capacitance effect, an electrical potential must thus be applied to the rods 24 and the vanes 22 of the helix 21. This is achieved by connecting a rear end 24' of each of the rods 24 and the central support 16 of the helix 21 to a current source 40 which provides a direct pulsating current which results in further control of the vibration of the rods 24. With the purpose of providing the pulsating electric energy to rods 24, the invention includes in these rods an electrode end 28, which is secured to cap 15 of tubular container 11, in such a way that it is placed at a certain distance apart from a connector-stopper 29 that is threaded to the cap 15. This connector-stopper 29, one for each of rods 24, has a perforation 29', in which the end of a conductor 30 is inserted, for connection to the current source 40. The passage of an electrical current will operate the capacitance media formed by vibration rods 24, vanes 22, and perforations 23, which capacitance effect will be produced when an electrical arc is formed in an open space 31, between the end of the conductor 30, in the connector-stopper 29, and the electrode end 28 of the elongated or rod 24.

Figure 9:
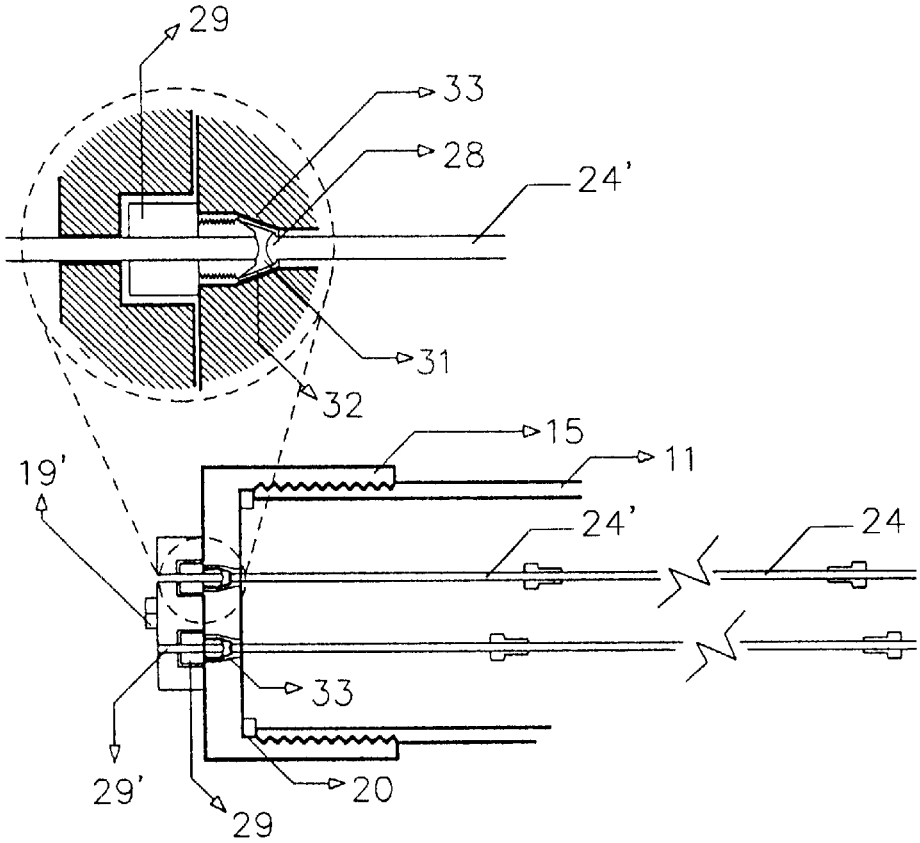
FIG. 9 illustrates in a lateral elevation and cross section of the back part of the device, the open end of the tubular container and its cap which includes watertight seals and electrical connection media for the vibration rod ends, which connection is of the electrical arc type, due to the open space between the end of the rod and the electrode cap.
Figure 10:
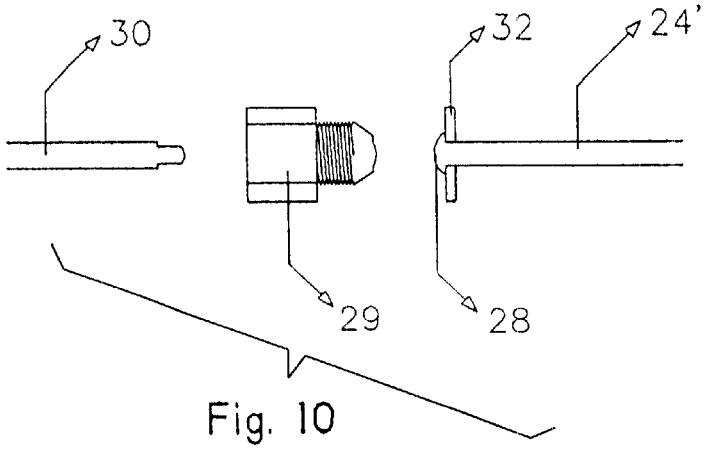
FIG. 10 illustrates in an exploded view, the conductor to the electrical system, the closing stopper that contains and retains this conductor and the end of the vibration rod provided with its electrode and deformable washer with watertight seal.

In the enlarged cross section view of FIG. 9, and in FIG. 10, the corresponding connection of these elements may be seen, as well as the open space 31 in which the electrical arc is formed.

The assembly of cap 15 and connector stoppers 29, is watertight by means of the annular washer 20, and a plurality of deformable washers 32, one placed at the electrode end 28 of each of the rods 24. More particularly, on each of a plurality of conical openings 33 in the cap 15, one of the washers 32 is provided, which assumes a conical shape upon being deformed that seals the openings 33 and the rods 24, thereby not allowing any leakage of the liquid flowing through the container 11, but providing the electrical connection of the rods 24 to the current source 40.

As described and illustrated in FIG. 2, the central tubular support cylinder 16 preferably contains semiconductor media 34 which is provided in order to generate a magnetic field. This field will also have an effect on the rods or elongated bodies 24, in order to assist in the frequency and intensity control of their vibration or undulation.

A description has been made of this basic modality of the invention, which comprises a device to allow the passage of, liquid mass through a conduction helix in which a set of rods, or elongated bodies, operate, resulting from the pressure applied by the liquid mass on the elastic rods in a displacement of said rods, which return to their original position and initiate an oscillation or vibration, that continues due to the constant pressure exerted by the flow of the liquid mass.

This vibration is increased by the pulsating electrical capacitance effect over the rods as each rod moves close to and away from the vane's conductive material, thereby producing an increase of the rods vibration and controlling its frequency. This control over the frequency is also fine tuned by the action of a permanent magnetic field produced by the semiconductors in the central tubular support affixed to the tubular container.

The design of the components of this device and their combined operation provide on the liquid mass flowing inside the device a vibration, which in its harmonic frequencies is transmitted to the liquid, which being an incompressible medium, in turn transmits these vibrations to the biological content of the liquid mass; i.e., algae, fungi, bacteria and viruses, thereby destroying them or inhibiting their vital functions.

The device, as designed and constructed as described, can be advantageously used when there is liquid which has to be treated by any means for the suppression or destruction of algae, fungi, bacteria or viruses. This is the case of water purification plants, in which it is expected to obtain a liquid that is not only treated for the suppression of salts or non-desired chemical components, but is also treated to suppress or destroy any biological content which is harmful to consumers.

What is claimed is:

1. A device for the treatment of liquids in a flow stream comprising:

a support disposed in a flow stream of liquid to be treated;

a helix attached to said support and including a plurality of vanes each having a corresponding plurality of perforations therein;

a plurality of elongated elastic rods attached to said helix and passing through said perforations in said vanes, said vanes serving to direct said liquid flow stream into contact with said rods, thereby imparting a displacement force thereto, which in turn results in a vibration of said rods; and a source of pulsating current connected to said rods and said vanes that creates an electrical capacitance effect that further enhances the vibration of said rods.

2. The device of claim 1, wherein said rods are selected to have different lengths to thereby generate vibrations at different frequencies.

3. The device of claim 1, further including a tubular container for housing said support and said rods, said tubular container having an inlet for receiving a liquid flow stream and an outlet for discharging said liquid flow stream after treatment.

4. A device for the treatment of liquids in a flow stream comprising:

a support disposed in a flow stream of liquid to be treated;

a helix attached to said support and including a plurality of vanes each having a corresponding plurality of perforations therein; and a plurality of elongated elastic rods attached to said helix and passing through said perforations in said vanes, each of said rods being separated from said vanes by means of an insulating material in each of said perforations;

whereby, said vanes direct said liquid flow stream into contact with said rods, thereby imparting a displacement force thereto, which in turn results in a vibration of said rods.

5. The device of claim 4, wherein said support further includes permanent magnetic field generating means to enhance still further the vibration of said rods.

6. The device of claim 5, wherein said magnetic field generating means comprises semiconductor media disposed in said support.

7. A device for the treatment of liquids in a flow stream comprising:

a support disposed in a flow stream of liquid to be treated;

a helix attached to said support and including a plurality of vanes each having a corresponding plurality of perforations therein;

a plurality of elongated elastic rods attached to said helix and passing through said perforations in said vanes said vanes, serving to direct said liquid flow stream into contact with said rods, thereby imparting a displacement force thereto, which in turn results in a vibration of said rods; and permanent magnetic field means in said support for enhancing the vibration of said rods.

8. The device of claim 7, wherein said magnetic field generating means comprises semiconductor media disposed in said support.

9. A device for the treatment of liquids in a flow stream comprising:

a tubular container having an inlet for receiving a liquid flow stream to be treated and an outlet for discharging said flow stream after treatment;

a support disposed in said container;

a helix attached to said support and including a plurality of vanes, each having a plurality of perforations disposed therein;

a plurality of elongated elastic rods attached to one of said vanes of said helix and extending through said perforations of other of said vanes of said helix; said vanes serving to direct said liquid flow stream into contact with said rods, thereby imparting a displacement force thereto, which results in a vibration of said rods and in turn imparts a vibration to said liquid, thereby treating said liquid; and a source of pulsating current connected to said rods and said vanes that creates an electrical capacitance effect that further enhances the vibration of said rods.

10. The device of claim 9, wherein each of said rods is separated from said vanes by means of an insulating material in each of said perforations.

11. The device of claim 9, wherein said support further includes permanent magnetic field generating means to enhance still further the vibration of said rods.

12. The device of claim 11,wherein said magnetic field generating means comprises semiconductor media disposed in said support.

13. The device of claim 9, wherein said rods are selected to have different lengths to thereby generate vibrations at different frequencies.

* * * * *